US006829904B2

(12) United States Patent
Roh et al.

(10) Patent No.: US 6,829,904 B2
(45) Date of Patent: Dec. 14, 2004

(54) INTERNET REFRIGERATOR HAVING A HEAT SINK PLATE

(75) Inventors: Young Hoon Roh, Seoul (KR); Jung Ho Kim, Seoul (KR); Jin Cheol Cho, Seoul (KR); Jae Won Chang, Seoul (KR); Sang Hyuk Kang, Pusan (KR); Sang Mahn Kim, Kyunggi-do (KR); Pan Su Kim, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/661,601

(22) Filed: Sep. 15, 2003

(65) Prior Publication Data

US 2004/0060320 A1 Apr. 1, 2004

(30) Foreign Application Priority Data

Sep. 13, 2002 (KR) ..... 10-2002-0055791

(51) Int. Cl.[7] ..... F25D 23/12
(52) U.S. Cl. ..... 62/259.2; 165/80.3; 361/697
(58) Field of Search ..... 62/259.2, 434, 62/435, 440, 441; 165/80.3; 361/691, 697

(56) References Cited

U.S. PATENT DOCUMENTS 5,220,809 A * 6/1993 Voss ..... 62/259.2
5,706,668 A * 1/1998 Hilpert ..... 62/259.2
6,023,934 A * 2/2000 Gold ..... 62/51.1
6,233,959 B1 * 5/2001 Kang et al. ..... 62/259.2
6,519,963 B2 * 2/2003 Maeda ..... 62/259.2
6,675,590 B2 * 1/2004 Aarestrup ..... 62/126
6,704,202 B1 * 3/2004 Hamaoka et al. ..... 361/704

* cited by examiner

*Primary Examiner*—William E. Tapolcai
(74) *Attorney, Agent, or Firm*—Greenblum & Bernstein, P.L.C.

(57) ABSTRACT

An Internet refrigerator with a heat sink uses cold air from the Internet refrigerator itself, without a CPU cooling fan on a main board. The Internet refrigerator includes a main board with a chip set thereon and a temperature sensor that detects a temperature of the main board. A heat sink plate faces a surface of the main board and absorbs heat generated from the chip set. A pipeline having both ends connected to an interior of a cooled compartment of the refrigerator is arranged to contact a lower surface of the main board at a portion thereof. Additionally, a cooling fan can be arranged in the cooled compartment of the refrigerator for introducing cold air from the cooled compartment of the refrigerator into the pipeline.

15 Claims, 5 Drawing Sheets

INTERNET REFRIGERATOR HAVING A HEAT SINK PLATE

RELATED APPLICATIONS

The present disclosure relates to subject matter contained in Korean Application No. 2002-0055791, filed on Sep. 13, 2002, which is herein expressly incorporated by reference in its entirety.

BACKGROUND OF THE INVENTION

1. Field of the Invention

The present invention relates to an Internet refrigerator, and more particularly to an Internet refrigerator serving as a home networking server and a multimedia server which has a hardware platform including a high performance central processing unit (CPU) generating a large amount of heat, wherein the Internet refrigerator has a heat sink that utilizes cold air from the refrigerator itself.

2. Description of the Prior Art

With the recent increase in Internet use, the use of home appliances for accessing the Internet has also greatly increased. Further, as the Internet can be accessed through the use of a mobile handset such as a mobile phone or a personal digital assistant (PDA) without using a computer, the number of users of the Internet greatly have increased. Furthermore, home appliances which additionally have a network connection function, enabling housekeepers to access the Internet through the use thereof, are becoming more wide spread.

To expedite such a trend, not only a network for home networking systems should be established but also home networking servers which manage and control a plurality of home appliances either in a home or at remote sites via the Internet should be connected to the Internet. In the present application, the conventional art and the present invention will be described assuming that the home networking server is an Internet refrigerator.

To enable the Internet refrigerator 1 to act as a home networking server, the Internet refrigerator 1 is provided with a display unit at an external surface thereof so that web pages or the operational state of the refrigerator may be displayed thereon, and with an input unit so as to input commands therethrough. The display unit 2 and the input unit are preferably a touch pad simultaneously acting as an input device and a display device for efficient arrangement of the components thereof.

Referring to FIG. 1, the Internet refrigerator comprises a refrigerator 1, a display unit 2 arranged at an external surface of the refrigerator 1, and a main board 3 with a chip set including a high performance CPU arranged at an upper portion thereof. The data processing result of the chip set is displayed on the display unit 2. Since the chip set processes signals to control a plurality of home appliances connected to a home networking system and processes software modules to display Internet web pages on the display unit 2, the chip set must have a capacity large enough to process a large amount of data.

FIG. 2 is an exploded, perspective view of an Internet refrigerator in accordance with the conventional art. Referring to FIG. 2, an Internet refrigerator comprises a refrigerator 1, a main board 3 arranged at an upper portion thereof for processing control signals and data, and a display unit 2 for displaying the data and signal processing results of the main board 3.

Since a cooling fan is attached to the main board 3, the total thickness of the main board 3 inevitably becomes thicker than the thickness of the main board 3 alone. As the performance or operational load of the main board 3 increases, a chip set mounted on the main board generates a larger amount of heat, so that the temperature of the main board 3 increases. In some cases, the temperature increase may cause the chip set to malfunction. Particularly, a CPU mounted on a left side of the main board 3 is the greatest heat generator, so that the CPU necessarily requires a cooling fan. There are various types of cooling arrangements. For example, there is a cooling fan arrangement including a plurality of small cooling fans, a cooling fan having a larger fan than a normal-size fan, and/or a cooling fan having a rapid rotation speed. Those cooling fan arrangements described above are disadvantageous in that they increase the total thickness of the main board.

In typical Internet refrigerators, with reference to FIG. 1, the main board 3 is arranged on the top of the refrigerator 1. Accordingly, as the total thickness of the main board 3 increases, the total height of the Internet refrigerator also increases. As a result, the installation location of the Internet refrigerator is limited by the increased height of the Internet refrigerator. Further, since a heat sinking (i.e. dissipating) capacity of a cooling fan is insufficient with respect to the large amount of heat generated by the chip set on the main board, the life span of the chip set is shortened and control errors in the Internet refrigerator are more likely to occur.

SUMMARY OF THE INVENTION

Therefore, the present invention has been made in view of the above problem. It is an object of the present invention to provide an Internet refrigerator serving as a home networking server and a multimedia server, and capable of using an Internet. The Internet refrigerator has a heat sink plate facing a surface of a main board for dispersing heat generated by a chip set mounted on the main board, and has a pipeline contacting a surface of the heat sink plate through which cold air in the Internet refrigerator passes to cool the heat sink plate, so that overheating of the chip set is prevented and the total height of the refrigerator is reduced by eliminating a cooling fan on the main board.

In accordance with one aspect of the present invention, the above and other objects can be accomplished by the Internet refrigerator which comprises a main board on which a chip set is arranged, a heat sink plate facing a surface of the main board and absorbing heat generated from the chip set, and a pipeline having both ends connected to an interior of a freezer compartment of the refrigerator and arranged to contact a lower surface of the heat sink plate at a portion thereof so as to provide heat exchange between the freezer compartment of the refrigerator and the heat sink plate.

In accordance with another aspect of the present invention, there is provided an Internet refrigerator, comprising a main board with a chip set thereon, a temperature sensor that detects a temperature of the main board, a heat sink plate facing a surface of the main board and absorbing heat generated by the chip set, a pipeline having both ends connected to an interior of a cooled compartment of the refrigerator and arranged to contact a lower surface of the main board at a portion thereof so as to transfer cold air from the cooled compartment of the refrigerator to the heat sink plate, and a cooling fan arranged in the cooled compartment of the refrigerator that introduces the cold air generated in the cooled compartment of the refrigerator, into the aforementioned pipeline.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

A detailed description of an Internet refrigerator in accordance with a preferred embodiment of the present invention will be given below with reference to the accompanying drawings.

Figure 1:
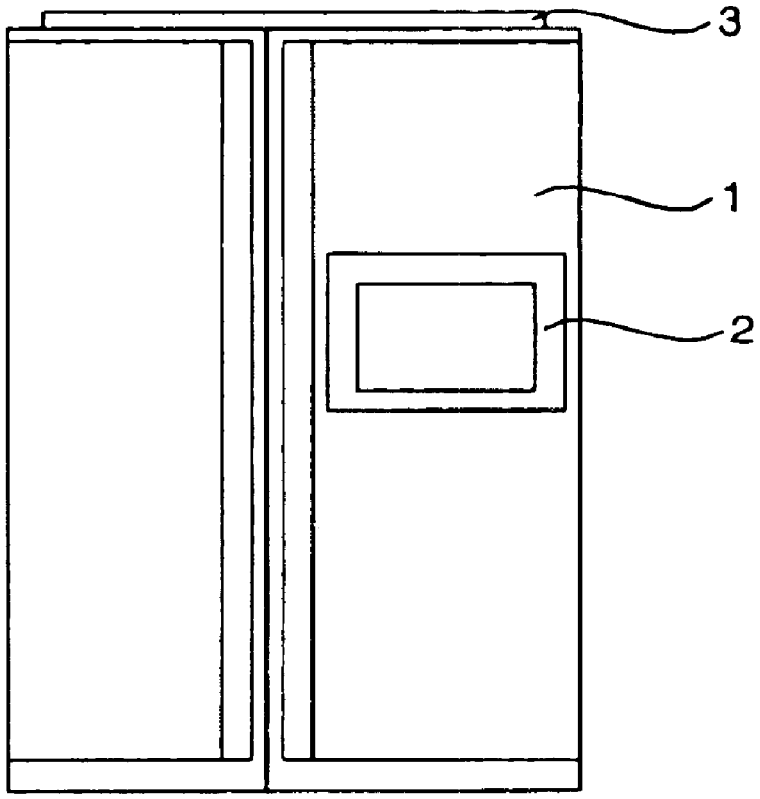
FIG. 1(Prior Art)
FIG. 1 is a front view of an Internet refrigerator in accordance with the conventional art.
Figure 2:
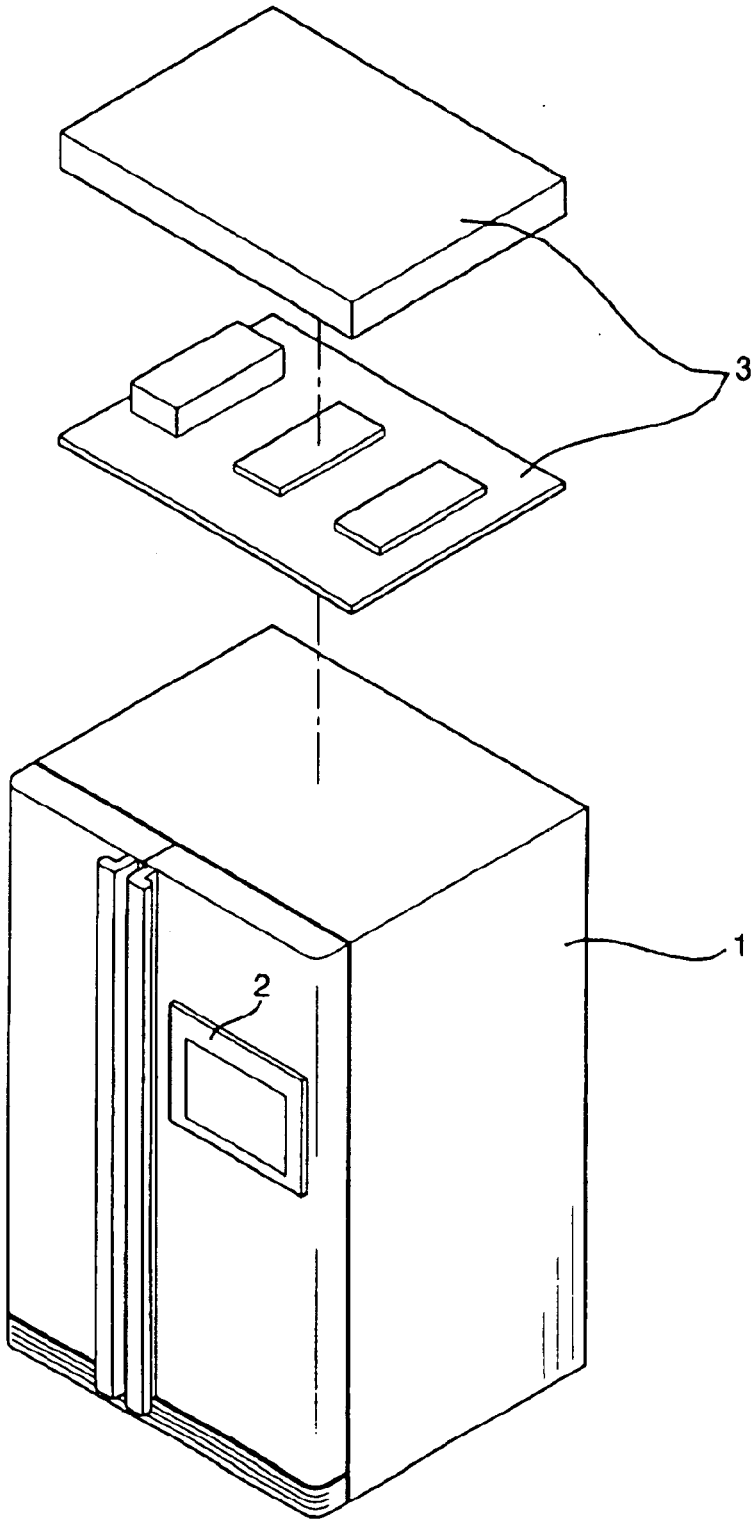
FIG. 2(Prior Art)
FIG. 2 is an exploded perspective view of an Internet refrigerator in accordance with the conventional art.
Figure 3:
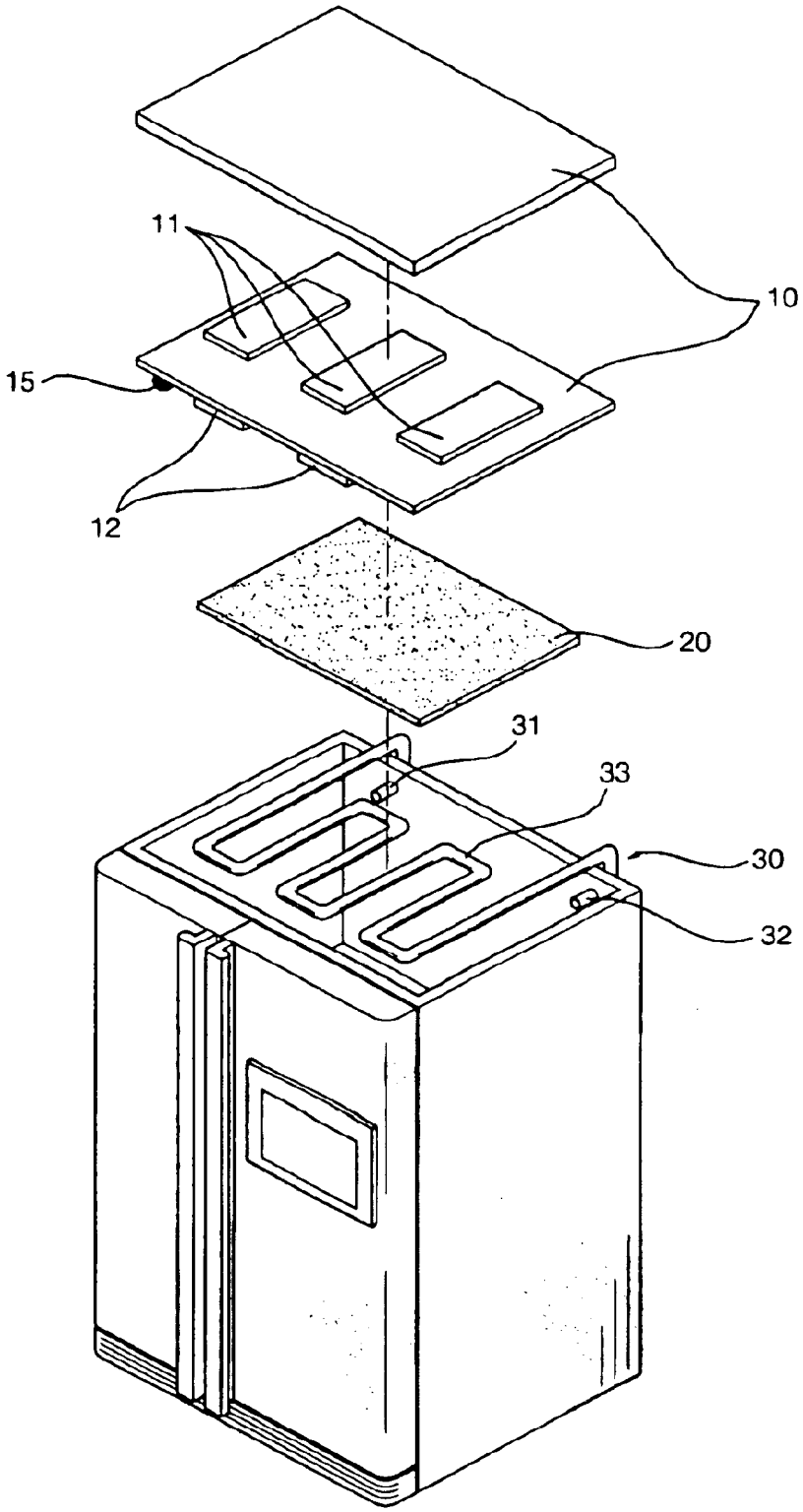
FIG. 3 is an exploded perspective view of an Internet refrigerator in accordance with a first embodiment of the present invention.
Figure 4:
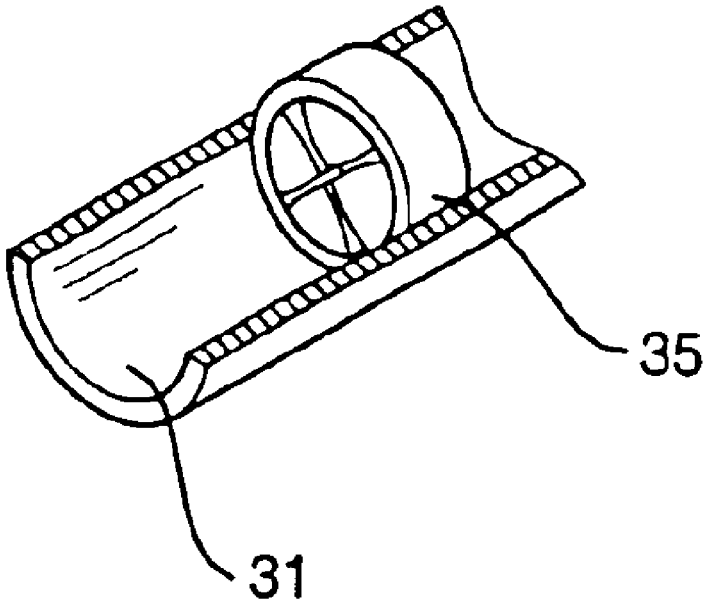
FIG. 4 is a perspective view of a pipeline which is partially cut out and associated with an Internet refrigerator in accordance with the present invention.
Figure 5:
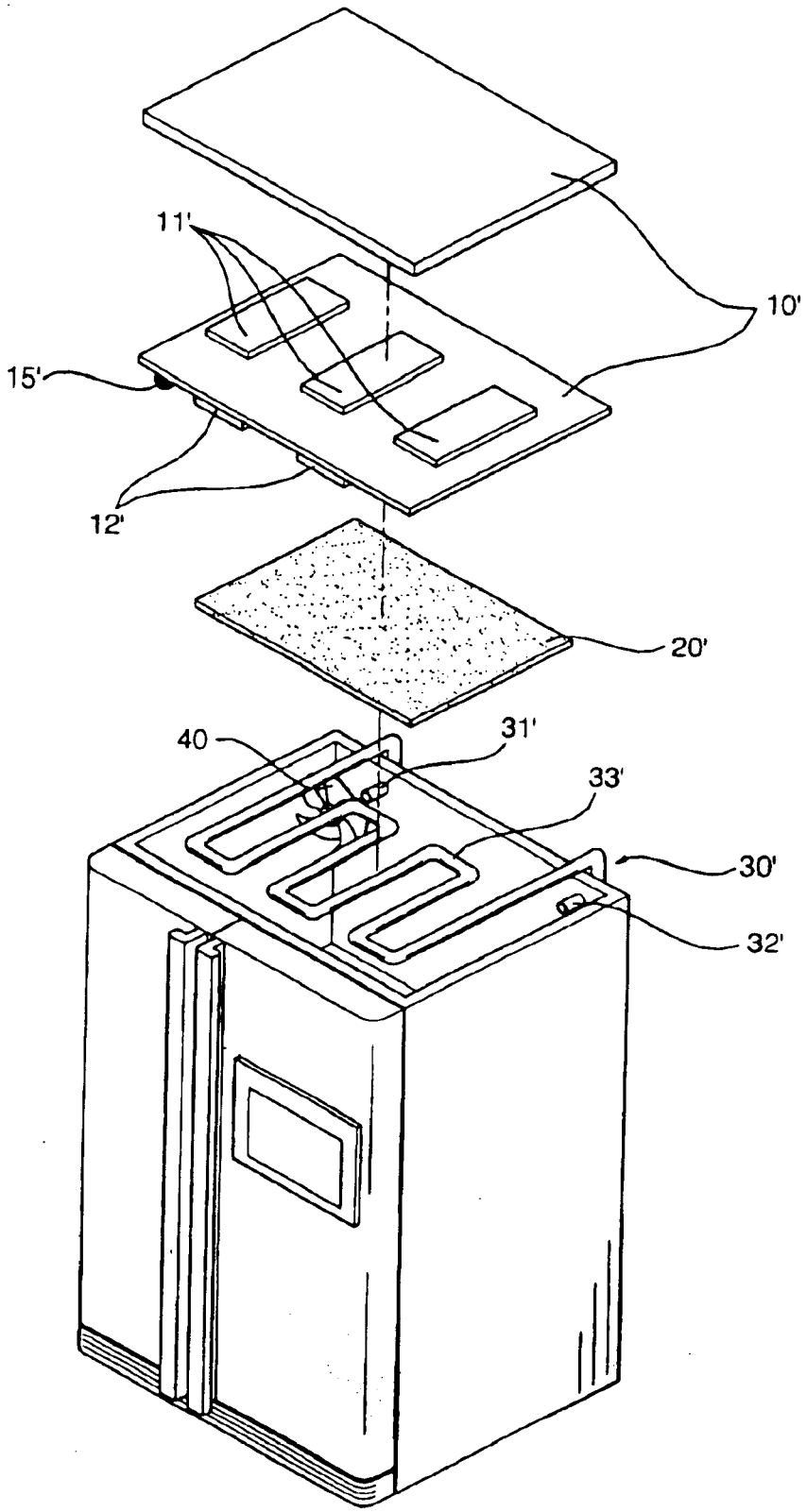
FIG. 5 is an exploded perspective view of an Internet refrigerator in accordance with a second embodiment of the present invention.

FIG. 3 is an exploded perspective view of an Internet refrigerator in accordance with a first embodiment of the present invention, FIG. 4 illustrates a partially cut out pipeline or conduit for use in the Internet refrigerator in accordance with the present invention, and FIG. 5 is an exploded perspective view of an Internet refrigerator in accordance with a second embodiment of the present invention. In FIGS. 3 and 5, to illustrate the interior of the freezer compartment, the ceiling of the freezer compartment has been removed.

Referring to FIG. 3, an Internet refrigerator in accordance with a first embodiment of the present invention comprises a refrigerator, a display unit and a main circuit board which processes data and control signals to control the refrigerator in a home or at remote sites via an Internet.

The main board 10 has an upper surface and a lower surface, and integrated circuit chips can be mounted on both upper and lower surfaces of the main board 10. In certain cases, the integrated circuit chips can be mounted only on one of an upper surface and a lower surface, thereof.

The main board 10 is preferably mounted at the top of the refrigerator but is not limited thereto. Certain integrated circuit chips 11, generating relatively smaller amounts of heat are mounted on the upper surface of the main board 10 and the other integrated circuit chips 12, such as a CPU, generating relatively larger amounts of heat, are mounted on the lower surface of the main board 10. Since a cooling fan is not mounted on the main board 10 in the Internet refrigerator in accordance with the first embodiment of the present invention, the total thickness of the main board 10 is reduced in comparison that in the conventional Internet refrigerator.

The Internet refrigerator in accordance with the first embodiment of the present invention further includes a temperature sensor 15 that detects the temperature of the main board 10, which increases due to heat generation from the chip set mounted on the main board 10. The temperature sensor is installed on a surface of the main board 10.

The Internet refrigerator in accordance with the first embodiment of the present invention further includes a heat sink plate 20, arranged in parallel with the main board 10, to face the lower surface of the main board 10 in which a chip set generating a relatively larger amount of heat is mounted so that the heat generated from the chip set will be radiated through the heat sink plate 20, thus cooling the chip set. The heat sink plate 20 is preferably formed of a metal having a high thermal conductivity, such as copper or aluminum.

The Internet refrigerator in accordance with the first embodiment of the present invention further includes a pipeline or conduit 30 installed on a lower surface of the heat sink plate 20 and arranged at the top of the refrigerator. The pipeline 30 comprises a cold air input tube 31, a cold air output tube 32, and a main tube 33. The main tube 33 of the pipeline 30 is installed on the lower surface of the heat sink plate 20 so as to dissipate the heat generated by the chip set, using cold air passing therethrough. The main tube 33 of the pipeline 30 preferably has zigzag shape.

The main tube 33 of the pipeline may have "S" shape, a straight line shape, "U" shape or "V" shape based on a location of the chip set. A contact area of the main tube 33 to the heat sink plate 20 is varied depending on a shape of the main tube 33. As the contact area of the main tube 33 to the lower surface of the heat sink plate 20 becomes larger, heat sink efficiency is increased. In accordance with the first embodiment of the present invention, assuming the chips 11 and 12 are arranged at regular intervals on the upper and lower surfaces of the main board 10 and generate almost uniform amounts of heat, the main tube 33 of the pipeline 30 has zigzag shape. Each end of the cold air input tube 31 and the cold air output tube 32 is connected to the freezer (or another cooled) compartment of the refrigerator, so that cold air in the freezer (or other cooled) compartment of the refrigerator can pass through the pipeline 30.

The heat sink 20 is positioned where the heat generated from the main board 10 and the cold air originating from the freezer compartment meet, and thermal equilibrium is accomplished. Accordingly, condensate water is likely to be produced on the surface of the heat sink when the heat and the cold air passing through the pipeline 30 meet. Therefore, it is preferable that the heat sink plate 20 be coated with a dehumidifying material.

Referring to FIG. 4, each of the cold air input tube 31 and the cold air output tube 32 of the pipeline 30 is provided with a valve 35 respectively therein so that the passage through the pipeline 30 is opened by the valve 35 when the temperature sensor 15 detects a temperature higher than a predetermined temperature, and the passage of the pipeline 30 is closed by the valve 35 when the temperature sensor 15 detects a temperature lower than the predetermined temperature.

The valves 35 are opened and closed in response to an output signal of the temperature sensor 15. That is, when the chips 11, 12 are overheated, the valves 35 are opened in response to the output of the temperature sensor, so that cold air in the freezer compartment of the refrigerator can pass through the pipeline 30. Thus, heat from the chips 11, 12 is dissipated by the pipeline 30 filled with cold air. On the other hand, when the chips 11, 12 are not overheated and the valves 35 are closed so that the cold air of the freezer compartment is not introduced into the pipeline 30 utilized to cool the freezer compartment.

FIG. 5 illustrates an Internet refrigerator in accordance with the second embodiment of the present invention. The Internet refrigerator in accordance with the second embodiment of the present invention additionally includes a cooling fan 40 with respect to the Internet refrigerator in accordance with the first embodiment of the present invention.

Referring to FIG. 5, an Internet refrigerator in accordance with the second embodiment of the present invention comprises a refrigerator and a display unit.

The Internet refrigerator in accordance with the second embodiment of the present invention further includes a main board 10' with chips or chip sets 11', 12' mounted on a surface or surfaces thereof, a temperature sensor 15' that detects a temperature of the main board 10', a heat sink plate 20' arranged to face a surface of the main board 10' to absorb the heat generated by the operations of the chips 11, 12, and a pipeline or conduit 30, which comprises a cold air input tube 31' having an end connected to the interior of a freezer compartment of the refrigerator, a cold air output tube 32' having an end connected to the interior of the freezer compartment of the refrigerator, and a main tube 33' installed to contact to the heat sink plate 20'.

The Internet refrigerator in accordance with the second embodiment of the present invention further includes a cooling fan 40. The cooling fan 40 is installed around the cold air input tube 31' in the freezer compartment of the refrigerator to rapidly induce the cool air in the freezer compartment into the pipeline 30' so that the heat of the main board is rapidly dissipated.

The operation of the cooling fan 40 is associated with the operation of the valves 35 installed in the cold air input tube 31' and the cold air output tube 32'. Accordingly, when the valves 35 in the cold air input tube 31' and the cold air output tube 32' are opened, the fan 40 starts to operate to blow cold air from the freezer compartment into the cold air input tube 31', thereby the chips 11, 12 are cooled. On the other hand, when the valves 35 in the cold air input tube 31' and the cold air output tube 32' are closed, the operation of the fan 40 stops and the cold air remains in the freezer compartment so that energy efficiency of the freezer compartment is increased.

That is, when the temperature of the main board 10' increases due to the heat generation of a CPU and the chips 11, 12, the temperature sensor 15' detects the increased temperature of the main board 10' and generates a control signal. At this time, the valves 35 are opened in response to the control signal, and the cooling fan 40 starts to operate to blow cold air from the freezer compartment into the pipeline 30'. Accordingly, the cold air introduced into the cold air input tube 31' of the pipeline 30' rapidly passes through the pipeline 30' and cools the chips 11', 12'.

As a result of cooling the main board 10' using the cold air in the freezer compartment of the refrigerator, if the temperature of the main board 10' is adequately lowered, the temperature sensor 15' closes the valves 35 in the cold air input tube 31' and the cold air output tube 32' so that the passage of the pipeline 30' is closed. Further, the rotational operation of the cooling fan 40 stops in accordance with the closing of the valves 35.

In the first and second embodiments of the present invention, the temperature sensors 15, 15' are operated in association with the valves 35 using an inverter which switches in response to the detection of the temperature sensors 15, 15'. Further, in the case that the temperature sensors 15, 15' are implemented by using a bi-metal principle, a metal having a relatively higher thermal expansion coefficient is deflected when the temperature of the main board is higher than a predetermined temperature, thereby the valves 35 on and off in an analog manner are switched.

An Internet refrigerator with a heat sink using cold air from a freezer compartment of a refrigerator is disclosed herewith with reference to accompanying drawings and embodiments described above, but the present invention is not limited by the drawings and the embodiments.

As described above, the Internet refrigerator in accordance with the present invention is advantageous in that deterioration or destruction of the chipsets is prevented, and operational stability of a main board with the chip sets is achieved because the chip sets are effectively and rapidly cooled when the chip sets are overheated, by using cold air from the freezer compartment of a refrigerator along with a heat sink plate.

Further, the Internet refrigerator in accordance with the present invention is advantageous in that the total height of the Internet refrigerator is reduced because a cooling fan is not additionally installed on the main board, so that the installation location of the Internet refrigerator can be more freely determined than that of a conventional Internet refrigerator. Further, since the cooling fan arranged in the freezer compartment of a refrigerator operates only when the temperature of a main board is higher than a predetermined temperature, power consumption is reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

In addition, although the present invention is discussed as directed to an Internet enabled refrigerator, it is also applicable to other Internet-enabled home appliances that have cold air available for cooling. Further, although a "side-by-side" refrigerator-freezer is discussed above, the present invention is also applicable to other styles of refrigerators and/or freezers.

What is claimed is:

1. An Internet refrigerator comprising:

a main board on which a chip set is mounted;

a heat sink plate facing a surface of the main board and absorbing heat generated by the chip set; and a pipeline having both ends connected to an interior of a freezer compartment of the refrigerator and arranged to contact a lower surface of the heat sink plate at a portion thereof, so as to provide heat exchange between the freezer compartment of the refrigerator to the heat sink plate.

2. The Internet refrigerator as set forth in claim 1, wherein a chip set generating a relatively small amount of heat is arranged on an upper surface of the main board and a chip set generating a relatively large amount of heat is arranged on the lower surface of the main board.

3. The Internet refrigerator as set forth in claim 1, wherein the heat sink plate is arranged to be facing the lower surface of the main board.

4. The Internet refrigerator as set forth in claim 1, wherein the heat sink plate is formed of one of copper and aluminum.

5. The Internet refrigerator as set forth in claim 1, wherein the heat sink plate is coated with a dehumidifying material, thereby preventing condensate water from being produced on surfaces of the heat sink plate.

6. The Internet refrigerator as set forth in claim 1, wherein the pipeline comprises a cold air input tube into which cold air from the freezer compartment of the refrigerator is introduced, a main tube which is a passage for the cold air introduced into the cold air input tube, and a cold air output tube that exhausts the cold air passed through the main tube to the freezer compartment of the refrigerator.

7. The Internet refrigerator as set forth in claim 6, wherein the main tube of the pipeline contacts the lower surface of the heat sink plate.

8. The Internet refrigerator as set forth in claim 7, wherein the main tube of the pipeline has a zigzag shape.

9. The Internet refrigerator as set forth in claim 1, further comprising a temperature sensor arranged on a surface of the main board, that detects a temperature of the main board, the temperature increasing due to heat generated by the chip set.

10. The Internet refrigerator as set forth in claim 9, further comprising a plurality of valves which open the pipeline to allow the cold air in the freezer compartment of the refrigerator to flow into the pipeline when the temperature detected by the temperature sensor is higher than a predetermined temperature, and close the pipeline when the temperature detected by the temperature sensor is lower than the predetermined temperature.

11. An Internet refrigerator comprising:

a main board with a chip set mounted thereon;

a temperature sensor that detects a temperature of the main board;

a heat sink plate facing a surface of the main board and absorbing heat generated by the chip set;

a pipeline having both ends connected to an interior of a cooled compartment of the refrigerator and arranged to contact a lower surface of the main board at a portion thereof so as to transfer cold air in the cooled compartment of the refrigerator to the heat sink plate; and a cooling fan arranged in the cooled compartment of the refrigerator, that introduces cold air from the cooled compartment of the refrigerator into the pipeline.

12. The Internet refrigerator as set forth in claim 11, further comprising a plurality of valves which open the pipeline to allow cold air from the cooled compartment of the refrigerator to flow into the pipeline when the temperature detected by the temperature sensor is higher than a predetermined temperature, and close of the pipeline when the temperature detected by the temperature sensor is lower than the predetermined temperature.

13. The Internet refrigerator as set forth in claim 12, wherein rotation of the cooling fan starts when the valves are opened and stops when the valves are closed.

14. The Internet refrigerator as set forth in claim 12, wherein the temperature sensor is a bi-metal sensor comprising two metals having different thermal expansion coefficients, respectively and the valves are opened and closed in response to deflection of a metal having a greater thermal expansion coefficient.

15. The Internet refrigerator as set forth in claim 11, wherein the temperature sensor is a bi-metal sensor comprising two metals having different thermal expansion coefficients, respectively.

* * * * *